United States Patent [19]

Jasperson et al.

[11] 4,055,121

[45] Oct. 25, 1977

[54] DEPTH CONTROLLED NAVAL MINE

[75] Inventors: Robert E. Jasperson, Annapolis, Md.; Charles G. Erb, Falls Church, Va.; Donald F. Haber, Cape St. Clair; Andrew A. Pouring, Edgewater, both of Md.

[73] Assignee: Trident Engineering Assoc., Inc., Annapolis, Md.

[21] Appl. No.: 758,766

[22] Filed: Sept. 10, 1968

[51] Int. Cl.[2] ..... F42B 22/18

[52] U.S. Cl. ..... 102/14

[58] Field of Search ..... 102/10, 13–17

[56] References Cited

U.S. PATENT DOCUMENTS

| | | | |
|---|---|---|---|
| 1,302,732 | 5/1919 | Troubtschaninoff | 102/16 |
| 1,440,596 | 1/1923 | Hammond, Jr. | 102/14 |
| 2,362,192 | 11/1944 | Delalande | 102/16 |
| 2,856,849 | 10/1958 | Ernest | 102/14 |

FOREIGN PATENT DOCUMENTS

| | | | |
|---|---|---|---|
| 706,513 | 3/1931 | France | 102/17 |

*Primary Examiner*—Verlin R. Pendegrass

[57] ABSTRACT

A tethered naval mine adapted automatically to maintain a predetermined depth below the surface of a body of water despite changes in water level. Provision is made for safeguarding operating personnel prior to deployment of the mine and to cause self-destruction thereof upon expiration of a predetermined period. The mine arrangement is such as to effect detonation either upon contact with a craft or by disturbances produced by the wake of a vessel or by mine-sweeping apparatus.

4 Claims, 3 Drawing Figures

INVENTORS
Robert E. Jasperson
Charles G. Erb
Donald F. Haber &
Andrew A. Pourins
BY
Michael Ch
ATTORNEY INVENTORS
Robert E. Jasperson
Charles G. Erb
Donald F. Haber &
Andrew A. Pouring
BY Michael Ohl
ATTORNEY

DEPTH CONTROLLED NAVAL MINE

This invention relates generally to naval mines, and in particular to a mine for use in relatively shallow water and adapted automatically to maintain a predetermined depth below the surface thereof.

Various types of naval mines have been known since the 16th century. But mines did not enter into wide use until the First World War and in the Second World War they were employed on a large scale. Naval mines fall into two broad categories — automatic and controlled. Once planted and armed, an automatic mine is activated by the presence of a ship, it being incapable of discriminating between a friendly and an enemy vessel. A controlled mine is connected by electric cable to a shore station and can be disarmed to allow friendly ships to pass. Most mines can only be laid in waters up to about 100 fathoms in depth.

A naval mine can be of the "contact" or "influence" type. A contact mine explodes only when actually touched by a ship, while an influence mine is capable of exploding when approached by a ship. The most common countermeasure for mines is the minesweeper which clears a path through areas that have been mined.

The main object of the present invention is to provide a naval mine which is automatic in a dual sense in that (a) it is automatically maintained at a predetermined depth below the surface of the water in which it is deployed, and (b) it is automatically activated by contact with or in the presence of a vessel.

When a conventional mine is laid in shallow water and is tethered by a given length of cable to an anchor, the depth of the mine below the surface of the water is fixed so as to maximize the effectiveness of the mine with respect to vessels having drafts which may range from a few inches to a few feet. However, the level of the water may change by reason of turning tides, rains or droughts, winds and freshets, thereby altering the depth of the mine relative to the surface of the water. As a consequence, the mine depth may at times become excessive and the mine may then be ineffective against surface craft having a shallow draft. Or the depth of the mine may become insufficient to avoid exposure and detection.

A significant feature of the present invention is that the mine includes means to sense the pressure of the water in which it is deployed, and in response to the pressure indication to adjust the depth of the mine below the surface of the water to maintain a desired depth regardless of changes in water level.

Also an object of the invention is to provide a mine having a detonatable charge and means to disable the mine and to safeguard operating personnel prior to the laying thereof.

Still another object of the invention is to provide a mine intended for use in relatively shallow water for a specified period of time, after which the device automatically destroys itself, thus obviating the problem of disposing of mines which have outlived their usefulness.

Yet another object of the invention is to provide a mine which will be actuated upon contact with surface craft or by disturbances resulting from the wake of a passing vessel or by minesweeping apparatus. Thus the mine is both of the contact and influence type.

For a better understanding of the invention as well as other objects and further features thereof, reference is made to the following detailed description to be read in conjunction with the accompanying drawings, wherein:

FIG. 3 is a side elevation of a non-tethered mine assembly in accordance with the invention.

THE TETHERED MINE STRUCTURE

Figure 1:
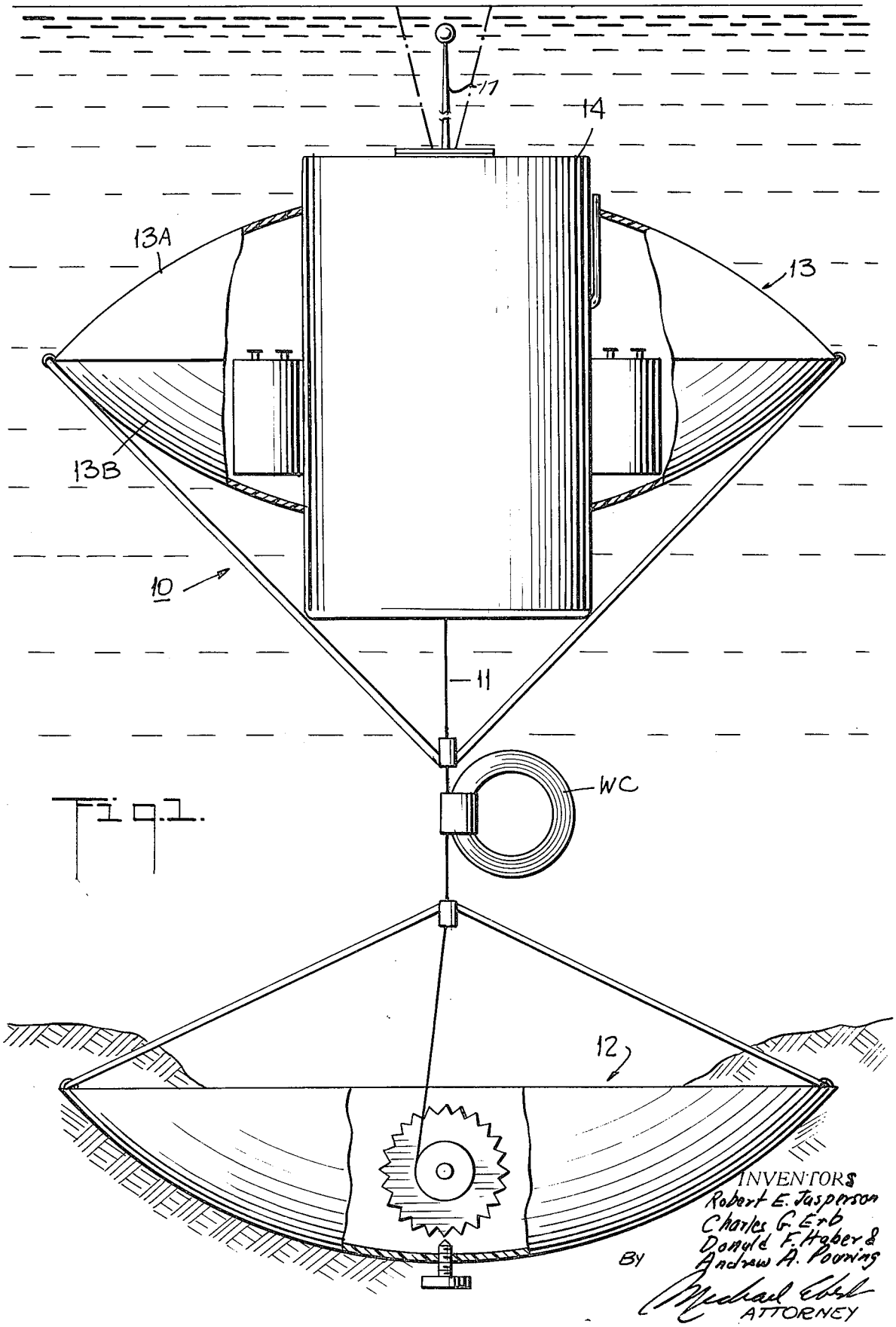
FIG. 1 is a side elevation of a tethered mine assembly in accordance with the invention.

Referring now to the drawing and more particularly to FIG. 1, there is shown a tethered mine assembly in accordance with the invention, which assembly is constituted by a submerged buoy structure, generally designated to numeral 10, moored by an extendible cable 11 to an anchor 12.

The buoy structure comprises a hollow casing 13, formed by a pair of complementary shells 13A and 13B having a shallow parabolic profile, the shells being preferably fabricated of molded plastic material or light weight metal. This axisymmetric configuration is advantageous in that the direction of fluid flow about the casing is normal to the axis of revolution, thereby reducing the effects of drag.

Inasmuch as the casing is subjected to various types of drag, these will now be analyzed.

A. Pressure drag composed of the following components:
   a. Wave Making Drag (forcing water to move against gravity)
   b. Form Drag (discontinuities creating flow separation)
   c. Interaction of components (a) and (b) on each other.

B. Skin Friction Drag (body surface discontinuities)

C. Wind Drag (wind resistance on exposed freeboard)

D. Surface Effect Drag (changing slope of wave or roll)

Because of the parabolic profile of casing 13, it orients itself to minimum cross-section resistance when introduced into the direction of fluid flow. This factor is of great importance in a moored system, and particularly for a submerged element when a taut line array is required to maintain a small "watch-circle" radius.

In any mooring system, one must take into account the motion of the buoy as a function of water perturbations. Ocean and river currents are continually changing in direction and velocity, with the result that a tethered submerged buoy must also adjust its attitude and position in order to establish an equilibrium of forces. This adjustment is known as the "mooring motion". With a buoy configuration in accordance with the invention, the effects of drag are minimized for the buoy tends to assume a position affording the least resistance.

Removably mounted within the casing is a cylindrical container 14 whose longitudinal axis coincides with the vertical axis of the casing. The container is preferably fabricated of a transparent plastic material such as acrylic to expose to view the elements housed therein.

Figure 2:
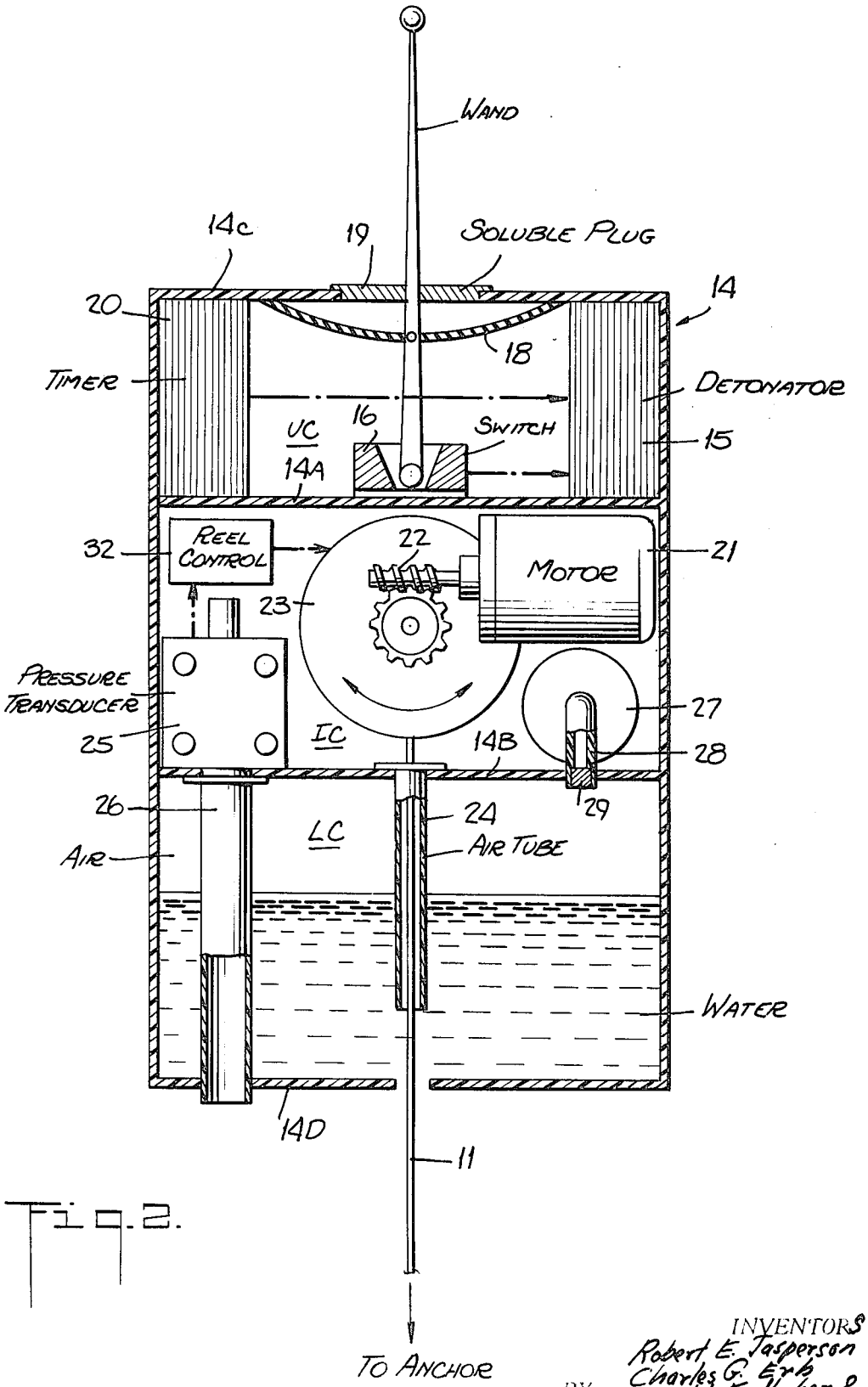
FIG. 2 is a section taken through the container included in the tethered assembly.
Figure 8:
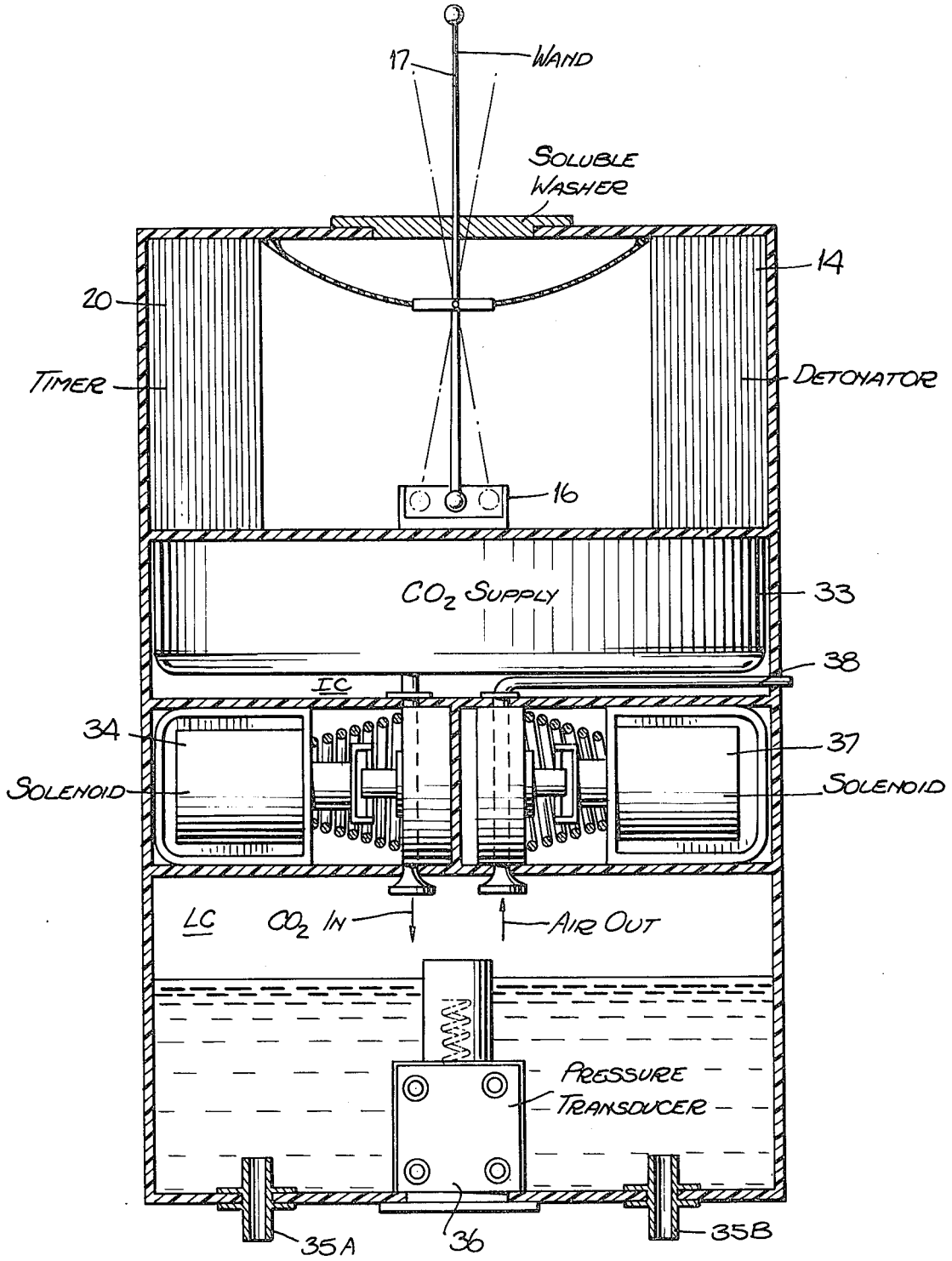

As shown in FIG. 2, container 14 is divided by partitions 14A and 14B into three distinct compartments; namely, an upper compartment UC, and intermediate compartment IC and a lower compartment LC. Disposed in the upper compartment UC is a detonator 15, which is operatively coupled to a high-explosive charge enclosed in the casing. This charge forms no part of the invention, its character being appropriate to the intended use of the mine.

Also housed within the upper compartment is a detonator switch 16 which is actuated by means of an extendible wand 17 in the form of a pendulum supported in an upright position by a flexible foot 18 attached to the rim of a circular opening in the top 14C of cylinder 14. Wand 17 may be fabricated of metal, glass, plastic or other suitable material. Prior to deployment, the wand is held rigidly in a vertical position by means of a soluble plug 19. The wand extends outside of the casing and functions as a trigger when coming in contact with a floating or submerged object.

A timing mechanism 20 is also disposed in upper compartment UC to record the passage of time, the timer closing a switch at the expiration of a predetermined period, which switch is connected to detonator 15. The timing mechanism may be in any standard form, such as a clock, a fuse, a plating device, such as an E-cell, a microcoulometer of the type manufactured by the Curtis Instrument Company or a simple dry cell discharging uniformly through a resistance.

Mounted within intermediate compartment IC is a bi-directional, d-c motor 21, which is protectively encapsulated. Motor 21 is operatively coupled by a reduction gear train 22 to a reel 23 upon which the upper end of cable 11 is wound, the cable entering compartment IC through a tube 24 depending downwardly from partition 14B.

Also supported within intermediate compartment IC is a pressure-sensitive transducer 25 which is coupled through tube 26 to the exterior of the cylinder, the transducer being capable of measuring variations in water pressure as a function of depth. Preferably, the transducer is one having an accuracy of 0.2 psi or better. Transducer 25 supplies a signal which is representative of water pressure to a control circuit 32 which is adapted to control the operation of buoy reel motor 21. This circuit is essentially equivalent to a double-pole switch which in one closed position causes the motor to reel-in the cable and in the other closed position causes the motor to reel-out the cable, the motor being arrested when the switch is open.

Also disposed in intermediate compartment IC is a small tank 27 containing pressurized air, the tank communicating with the lower compartment LC through a tube 28. Passage through tube 28 is initially blocked by a water-soluble valve 29.

The lower compartment LC serves as a water reservoir, the compartment having an opening in the bottom wall 14D of the container which admits water therein. Cable 11 passes through the same opening. The lower end of cable 11 is secured to anchor 12, which may be formed of metal, concrete, or other material having adequate weight and strength.

OPERATION OF TETHERED MINE

During storage and transportation, cylindrical container 14 is removed from the casing 13. Immediately before deployment either from an air or water-borne vehicle or even by a swimmer, container 14 is carefully inserted in mine casing 13 and secured thereto in a watertight fashion by means of sealing rings, mating screws and other well-known expedients.

In one practical embodiment, anchor cable 11 is about 100 feet in length. The bottom end of the cable is connected to anchor 12 and the top end to the spindle of buoy reel 23. Approximately 90 feet of the cable is coiled tightly and secured by a water-soluble clamp WC, the remaining 10 feet being wound about buoy reel 23.

Obviously the necessary length of the cable depends on the maximum depth of the waters for which the mine is intended, a 100-foot length being suitable for most purposes.

In the pre-launch mode, reel 23 is locked to gear train 22, thereby effectively marrying buoy 10 to anchor 12, the latter being contoured appropriately. When deployed, the mine and anchor assembly sink together in a horizontal position.

Separately, the mine casing is ballasted to be neutrally buoyant at a depth below the surface of 3 feet, while the anchor, being solid, will have negative buoyancy. When coupled together, as by coiling the lower 90 feet of the cable and securing the coils by a water-soluble clamp, the combined array will be neutrally buoyant at a depth of 10 feet. At the expiration of a selected interval, such as 15 minutes, the clamp will dissolve, the anchor will sink and the mine will ascend to within 3 feet of the surface. Simultaneously, the operating mechanism will be energized, the pressure transducer will sense changes in ambient water pressure and the motor-driven reel will be actuated to control the depth of the mine from the surface as a function of pressure.

Assuming that one desires to maintain the mine at a depth varying between 6 feet and 5 feet, pressure transducer 25 is arranged to actuate bi-directional motor 21 to permit buoy reel 23 to unwind. Upon passing a depth of six feet ($\approx 14.7 + 2.5 = 17.2$ psi), the transducer switch will open and the motor brought to a halt. Buoy reel 23 is held fast by the worm gear in gear train 22 when this gear is not rotating.

A rise in water surface level will increase water pressure, causing reel 23 to unwind and thereby allowing the mine to float upwardly. A decrease in surface level will lower in water pressure. At a pressure of about 17 psi ($14.7 + 2.3 = 17$ psi at 5 feet), cable 11 will be reeled in and the mine drawn downwardly. Changes in atmospheric pressure will produce similar results but to a negligible degree.

The length of wand 17 is adjusted to maintain its tip at a preselected depth when the mine is deployed and the locking plug 19 is dissolved. Wand 17 has freedom of movement about a vertical axis through an excursion limited by the flexibility of rubber boot 18.

Deflection of wand 17 from the vertical through a predetermined angle acts to actuate detonator switch 16, thereby setting off the explosive charge. This action occurs when wand 17 is contacted by a moving vessel. Similarly, if the mine is tilted from the horizontal to the same angular extent, switch 16 will be actuated to detonate the charge. Such tilting may be occasioned by the wake of a passing surface craft or by an attempt to sweep the mine. Hence the mine is both of the contact and influence type.

Since the mine is intended to be active for a period of limited duration to intercept hostile craft, the mine represents a hazard to other vessels once this period has expired. As the mine is not of the controlled type and cannot be disabled, one must destroy it once the active period (i.e., 2,000 hours) is over. This is done by timer mechanism 20, which may, for example, consist of a D-C motor rotating at 1 RPM to drive a pre-loaded decimal counter through a conventional 60-to-1 reduction gear, thereby producing a switching action at the 2,000th count to detonate the charge and destroy the mine.

NON-TETHERED MINE

In the embodiment of the mine shown in FIG. 3, the buoy is provided with a compartmentalized container similar to that in FIG. 2, the components housed in the upper compartment UC being the same. However, in place of a motorized reel responsive to changes in water pressure to adjust the depth of the buoy by varying the length of a tethering cable, the change in depth is effected only by varying the buoyance of the mine.

In this arrangement, a tank 33 containing a pressurized carbon dioxide or a similar gas is mounted within intermediate compartment IC, the tank communicating through a solenoid valve 34 with the lower compartment LC which is open to the water through tubes 35A and 35B attached to the bottom end of the container.

Solenoid valve 34 is operated by a pressure-sensitive transducer 36, mounted within lower compartment LC, the transducer also controlling the action of a second solenoid valve 37. The second valve regulates the release of gas from the lower compartment to the exterior through an outlet pipe 38.

In operation, when the mine depth exceeds a prescribed value, this is sensed by transducer 36 which causes solenoid valve 34 to open to admit $CO_2$ into the lower compartment, thereby forcing water out of this compartment and increasing the buoyancy of the mine. When, however, the depth falls below the prescribed value, solenoid 37 is actuated by the transducer to allow gas to escape from the lower compartment and permitting water to enter, thereby reducing the positive buoyance of the mine. Between the upper and lower depth valves, both valves 34 and 37 are closed and the system remains in condition of neutral buoyancy.

While there have been shown preferred embodiments of the invention it will be appreciated that many changes may be made therein without departing from the essential scope of the invention as defined in the annexed claims.

What we claim is:

1. A tethered automatic naval mine comprising

A. a buoyant casing formed with a parabolic profile and having an explosive charge therein, and B. a removable container insertable in said casing, said container including:

a. a detonator for said charge, b. a switch coupled to said detonator to set off said charge when the switch is closed, c. a wand operatively coupled to said switch and extending outside of said container, said wand normally occupying a vertical position and being caused to assume an angular position to actuate said switch when contacted by a passing craft, d. a pressure-sensitive transducer responsive to water pressure to provide a signal representative of the depth of said mine below the surface of the water, and e. means responsive to said signal to vary the depth of said mine to maintain said mine at a predetermined depth regardless of changes in the level of the water, said means including an extendible cable linking said mine to an anchor, the length of said cable being varied in response to said signal.

2. An automatic mine as set forth in claim 1, wherein said casing is axisymmetric and formed by a pair of complementary shells having a parabolic profile.

3. An automatic mine as set forth in claim 2, wherein said container is cylindrical and its axis coincides with the axis of the casing.

4. An automatic mine as set forth in claim 1, wherein said container includes a bi-directional and motorized reel for said cable, and means responsive to said transducer signal to cause said reel to wind or unwind said cable to vary the distance between the mine and the anchor therefor.

* * * * *